US005924578A

United States Patent [19]

McKenzie

[11] Patent Number: 5,924,578

[45] Date of Patent: Jul. 20, 1999

[54] CLOTHING HANGER HOLDER

[76] Inventor: Martha McKenzie, 1771 Country Club Rd., Eufaula, Ala. 36027

[21] Appl. No.: 08/811,772

[22] Filed: Mar. 7, 1997

[51] Int. Cl.[6] ..... A47F 5/01

[52] U.S. Cl. ..... 211/49.1; 211/106; 211/59.1; 223/85

[58] Field of Search ..... 211/49.1, 106, 211/59.1; 223/85

[56] References Cited

U.S. PATENT DOCUMENTS

| | | | |
|---|---|---|---|
| 978,422 | 12/1910 | Zizinia | 211/49.1 |
| 2,291,178 | 7/1942 | Vanderwerp et al. | 211/106 X |
| 2,461,374 | 2/1949 | Custer | 211/49.1 X |
| 2,530,609 | 11/1950 | Friedman | 211/49.1 |
| 2,609,919 | 9/1952 | Lee | 211/49.1 X |
| 3,814,008 | 6/1974 | Beshara | 211/49.1 X |
| 4,424,905 | 1/1984 | Keen | 211/49.1 |
| 4,768,658 | 9/1988 | Shafto | 211/49.1 |
| 4,919,278 | 4/1990 | Howen | 211/49.1 |

*Primary Examiner*—Daniel P. Stodola
*Assistant Examiner*—Khoa Tran
*Attorney, Agent, or Firm*—Robert L. Epstein; Harold James; James & Franklin

[57] ABSTRACT

First and second rods extend from spaced points on an open frame. The rods support a plurality of hangers situated in parallel planes. When the frame is mounted on a wall such that the rods extend horizontally, the hangers are retained on the rods by upwardly bent end sections. A third rod may be provided to engage the hanger near the point where the hook is attached. In one preferred embodiment, the upwardly bent end sections of the first and second rods are connected by an arcuate section and the third rod is joined to the arcuate section. A cover enclosing the hangers is employed in another preferred embodiment.

12 Claims, 5 Drawing Sheets

CLOTHING HANGER HOLDER

The present invention relates to a device for the storage of clothing hangers and more particularly to a clothing hanger holder adapted to be mounted on a wall or shelf and which includes retaining means to prevent accidental dislodgement of the hangers.

BACKGROUND OF THE INVENTION

FIELD OF THE INVENTION

Clothing hangers made of wood, plastic, metal or combinations thereof are in common use in the home. Empty hangers must be stored for use when needed. The empty hangers can be hung on the closet bar, along with those which are in use. However, storage of empty hangers in this way takes up limited closet space.

In order not to occupy hanging space, empty hangers could be stacked on a shelf in the closet or on the closet floor. However, hangers kept in such a manner tend to become tangled, making difficult to extract a single hanger when needed. They may also take up space needed for the storage of other things.

It is therefore a prime object of my invention to provide a holder for empty clothing hangers which can be mounted on a wall or shelf inside a closet so as not to take up limited hanging space.

It is another object of the present invention to provide a clothing hanger holder capable of holding a plurality of hangers, in side by side parallel planes, without tangling.

It is another object to provide a clothing hanger holder which includes means for retaining the hangers to prevent accidental dislodgement thereof.

BRIEF SUMMARY OF THE INVENTION

In accordance with the present invention, a holder for a plurality of clothing hangers is provided. The holder includes a frame and first and second hanger support rods extending from spaced points on the frame. Means are provided for mounting the frame to a surface. Means for retaining the hangers on the rods is provided to prevent accidental dislodgement thereof.

The retaining means may take the form of upwardly bent rod end sections. In one embodiment, the retaining means is an upwardly extending arcuate rod section connecting the first and second rods.

A third rod may be provided. The third rod extends from the frame at a location spaced from the first and second rods. The third rod extends in a direction substantially parallel to the first and second rods. In one preferred embodiment, the third rod joins the arcuate section.

A cover is provided extending from the frame for enclosing the area in which the hangers are situated. The cover defines a substantially triangular space. The cover includes a slot to accomodate the hooks of the hangers.

BRIEF DESCRIPTION OF THE DRAWINGS

To these and to such other objects which may hereinafter appear, the present invention relates to a clothing hanger holder as set forth in the following specification and recited in the annexed claims, wherein like numerals refer to like parts, and in which:

DETAILED DESCRIPTION OF THE INVENTION

Figure 1:
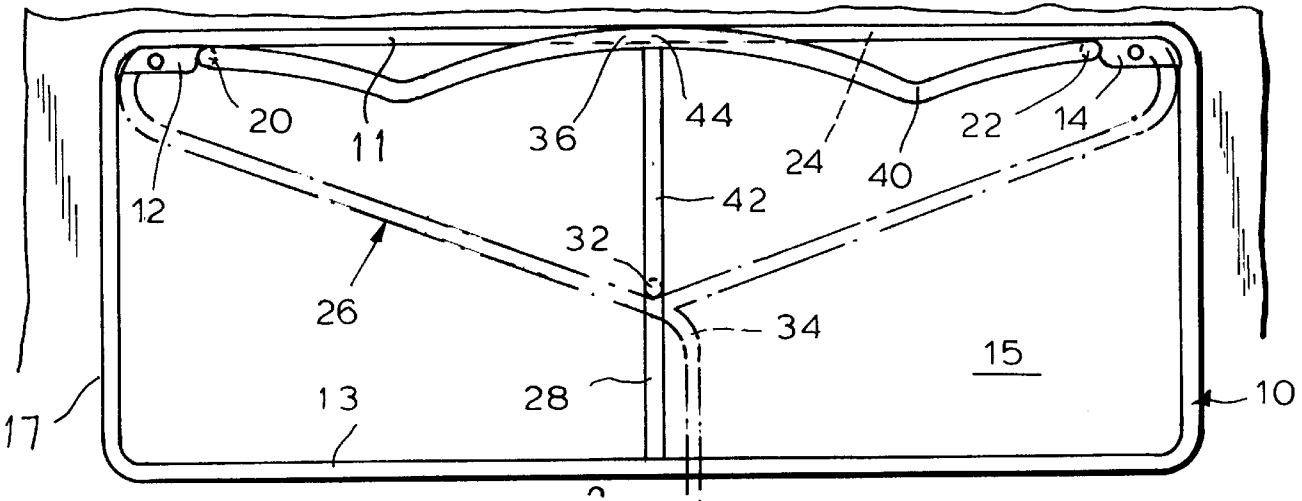
FIG. 1 is a front view of a first preferred embodiment of the present invention mounted on a wall.
Figure 2:
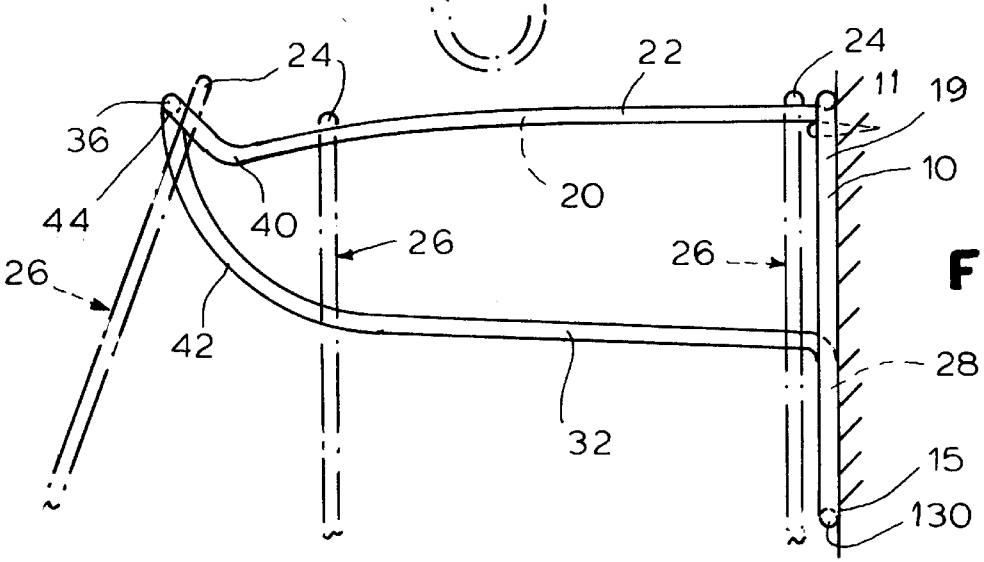
FIG. 2 is a side view of the first preferred embodiment of the present invention shown in FIG. 1.
Figures 3, 4, 5:
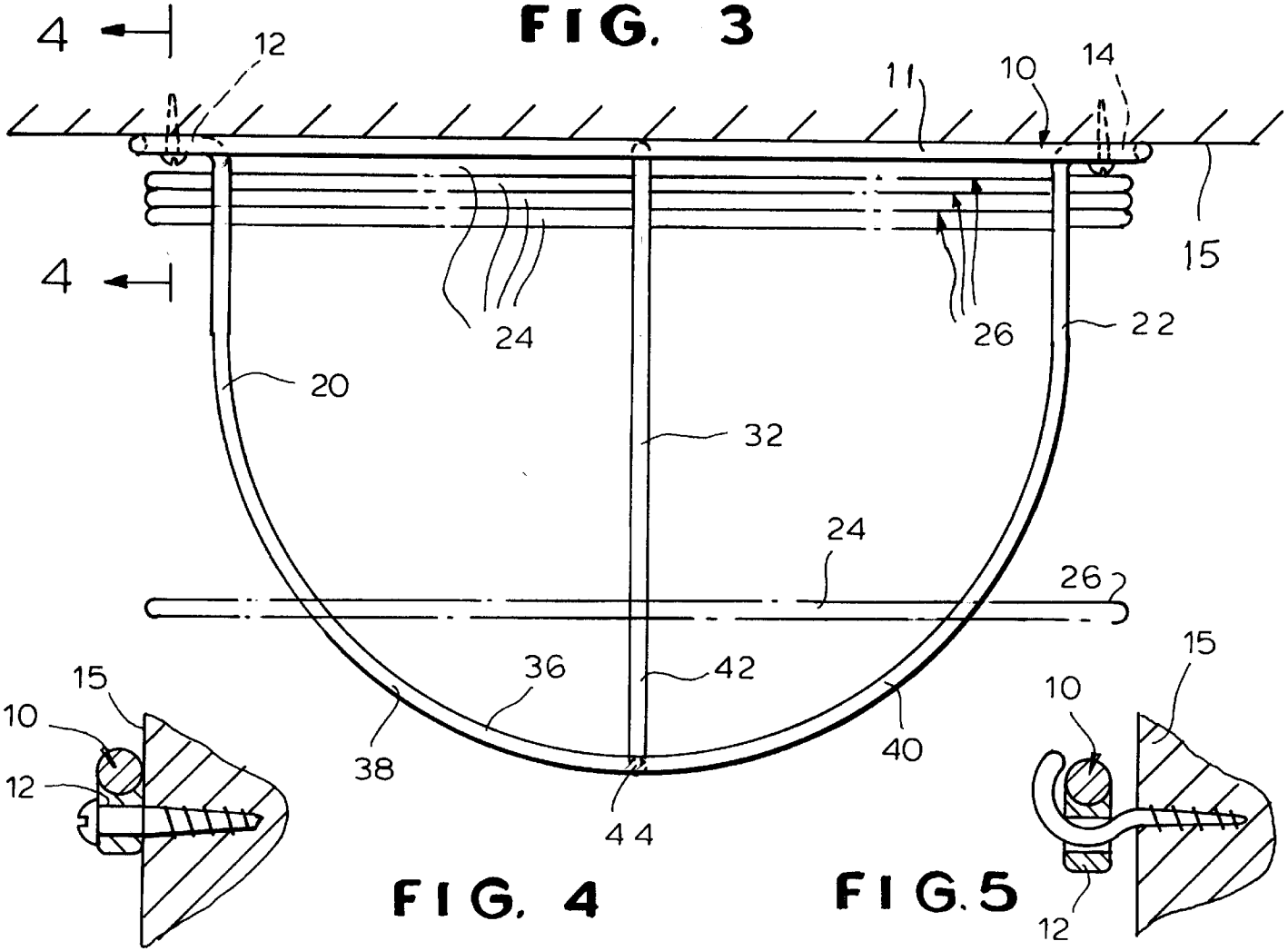
FIG. 3 is a top view of the first preferred embodiment of the present invention shown in FIG. 1.
FIG. 4 is a view taken along line 4—4 of FIG. 3 showing a screw type of mounting.
FIG. 5 is a view similar to FIG. 4 but showing a hook type mounting.

As seen in FIGS. 1, 2 and 3, the first preferred embodiment of the present invention is composed of metal rod material, preferrably coated with plastic. The base, generally designated 10, is an open rectangular frame formed of elements 11, 13, 17 and 19. As best seen in FIGS. 3 thru 5, the frame includes portions 12, 14, wider than the frame elements 11, 13, 17 and 19, which have openings therein suitable to accept fasteners to mount the frame to a wall 15. The fasteners may take the form of a pair of simple screws 16 or hooks 18 which extend through the openings in portions 12, 14 to anchor frame 10 to the wall.

Extending from the upper corners of base 10, proximate portions 12, 14, are rods 20, 22. Rods 20, 22 are adapted to support the ends of the bottoms 24 of a plurality of clothing hangers, generally designated 26, which are suspended from the rods in side by side parallel relation.

A rod section 28 extends in the plane of frame 10 from the middle of the lower horizontal base element 13 towards the interior of the frame. A third rod 32 extends from section 28 in a direction substantially parallel to rods 20, 22. Rod 32 is situated at a location proximate the point on hangers 26 where the sides of the hanger join and from which hook 34 extends.

In this preferred embodiment, rods 20 and 22 curve inwardly toward each other and are connected by an arcuate section 36 which projects upwardly from rods 20 and 22 at bends 38 and 40 therein. When rods 20, 22 extend horizontally, arcuate section 36 functions to retain the hangers on rods 20, 22 to prevent accidential dislodgment thereof. It forms a barrier over which the hangers must pass to be removed from the holder. The weight of the hangers tends to prevent the hangers from passing over section 36.

Rod 32 has an upwardly extending section 42. Section 42 is joined to arcuate section 36 near its midpoint 44. Third rod 32 not only serves to position the hangers, it also supports arcuate section 36.

Figure 6:
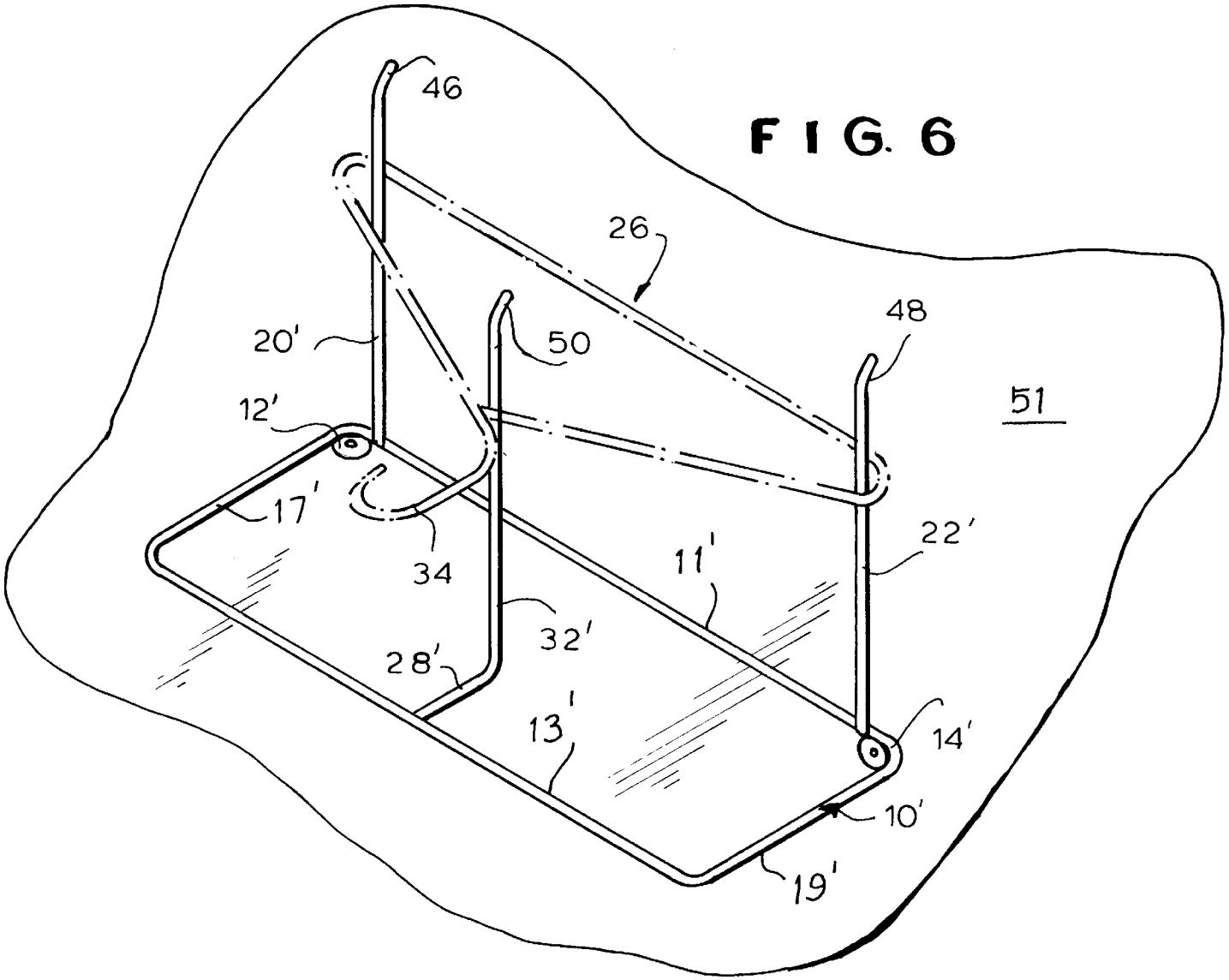
FIG. 6 is an isometric view of a second preferred embodiment of the present invention mounted in an upright manner.
Figures 7, 8:
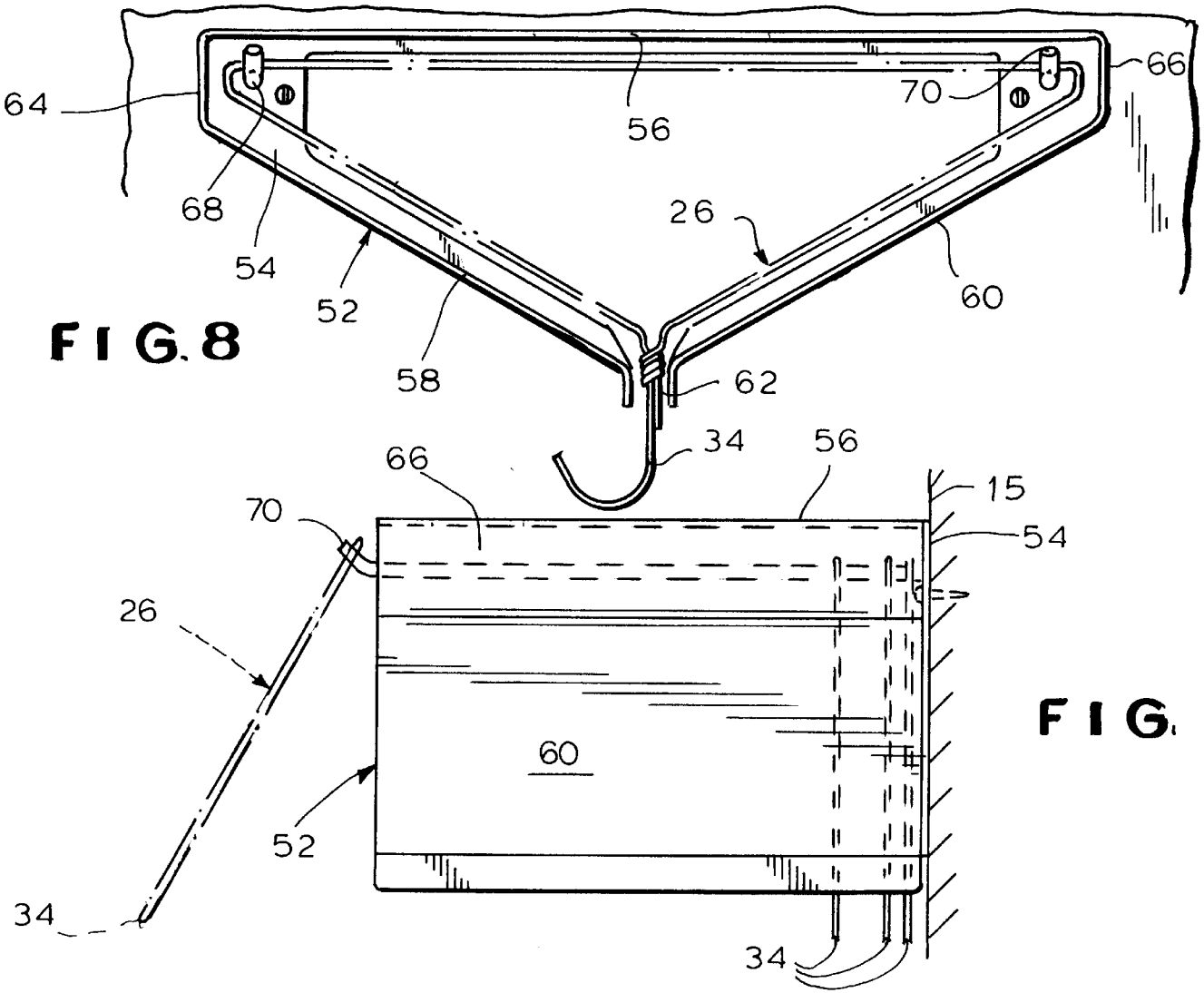
FIG. 7 is a side view of a third preferred embodiment of the present invention mounted on a wall.
FIG. 8 is a front view of the third preferred embodiment of the present invention shown in FIG. 7.
Figures 9, 10:
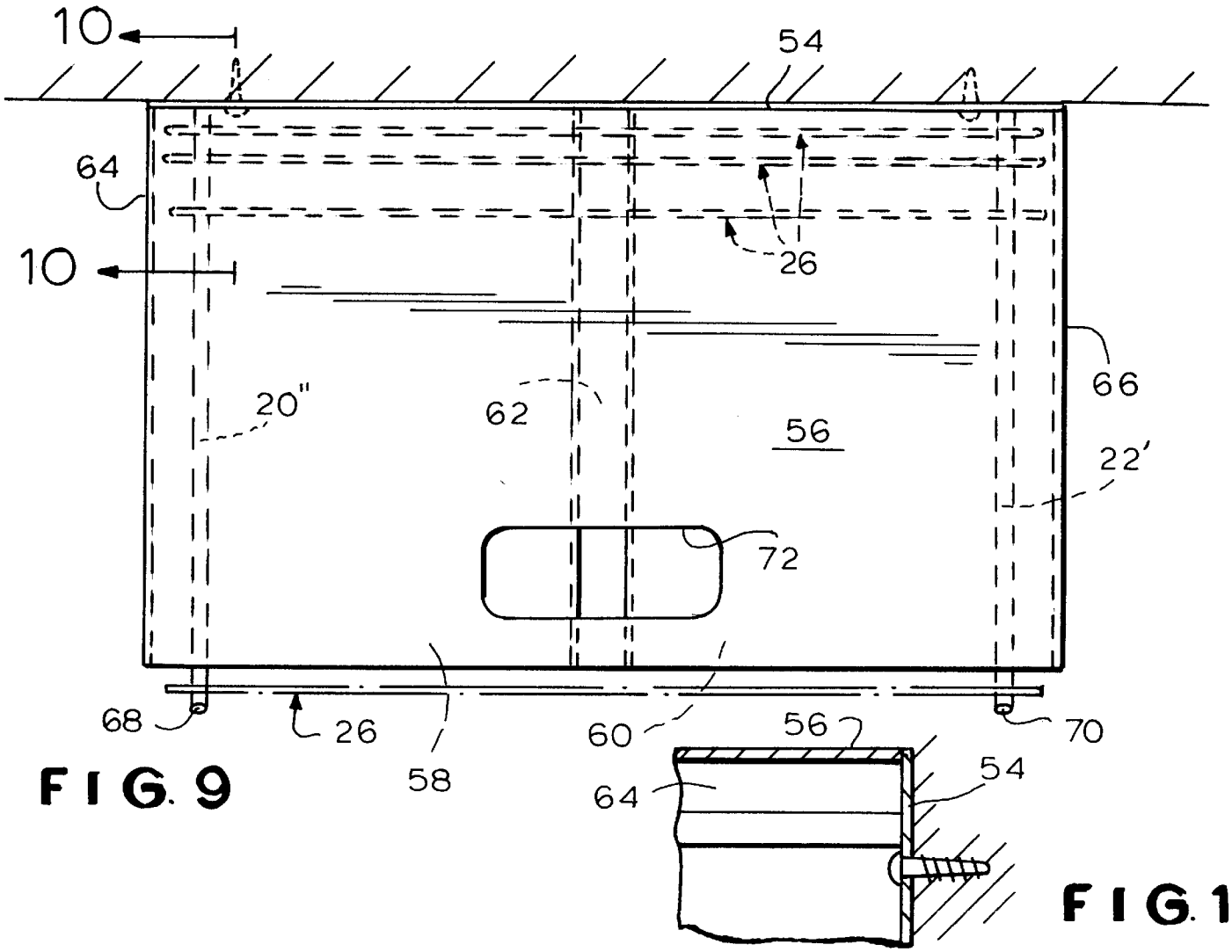
FIG. 9 is a top view of the third preferred embodiment of the present invention shown in FIG. 7.
FIG. 10 is a side view taken along line 10—10 of FIG. 9 of a screw type mounting.

The second preferred embodiment of the present invention, as shown in FIG. 6, is similar to the first embodiment except that the rods 20', 22' and 32' extending from base 10' are not curved toward each other or joined at a point spaced from the frame. In this embodiment, each rod 20', 22' and 32' is substantially straight with an upwardly bent end section 46, 48 and 50, respectively. Bent end sections 46, 48 and 50 function to retain the hanger on the holder, in the same manner as arcuate section 36 of the first embodiment, when the holder is mounted on a wall.

The second embodiment of the holder can be mounted on a wall by portions 12' and 14' in the same manner as the first embodiment or can rest upright on a horizontal surface 51, such as a shelf, as shown.

The third preferred embodiment is shown in FIGS. 7 through 10. In this embodiment, the lower or third rod 32 is eliminated. A generally triangular cover member 52 extends from frame 54. Cover 52 consists of a substantially planer top member 56, extending above rods 20" and 22". First and second oppositely inclined bottom members 58, 60 define a slot 62 therebetween, at their lower ends, to accomodate the hanger hooks. Members 58, 60 are connected to top member 56 by side portions 64, 66 respectively.

Cover 52 defines a triangular area within which the hangers are situated when suspended from rods 20", 22". Rods 20", 22" each have an upwardly bent end section 68, 70 respectively to prevent accidental dislodgement of the hangers.

Top member 56 is provided with a substantially rectangular opening 72. Opening 72 is adapted to accept the hand of a user to facilitate gripping of the holder. Thus, this preferred embodiment is useable to transport as well as to store hangers.

It should now be appreciated that the present invention is a clothing hanger holder which includes at least two spaced hanger support rods for suspending a plurality of clothing hangers in side by side parallel relation. The rods are provided with upwardly bent end sections which function to retain the hangers to prevent accidential dislodgment thereof. In one preferred embodiment, the rods are connected by an upwardly extending arcuate section. A third rod may be provided. Further, a cover enclosing the space where the hangers are situated may be employed.

While only a limited number of preferred embodiments are disclosed for purposes of illustration, it is obvious that many variations and modifications could be made thereto. It is intended to cover all of these variations and modifications which fall within the scope of the invention, as defined by the following claims:

I claim:

1. A holder for at least one hanger comprising a base, first and second hanger support rods extending in a plane from spaced points on said base, said first and second rods being connected by an arcuate section, at least a portion of said arcuate section being inclined relative to said plane, a third rod extending from said base to said arcuate section and means for mounting said base on a vertical surface.

2. The holder of claim 1 wherein said first, second and third rods extend from points on said base which form the vertices of a triangle.

3. The holder of claim 1 wherein said third rod has an arcuate portion.

4. The holder of claim 3 wherein said arcuate portion of said third rod is joined to said arcuate section.

5. The holder of claim 1 wherein said base comprises a member extending generally perpendicular to said plane wherein said third rod extends from said member.

6. The holder of claim 1 wherein said base has a generally rectangular configuration including two corners and wherein said mounting means are situated proximate said corners.

7. In combination, a hanger having a bottom member and a holder for said hanger, said holder comprising a base, first and second rods extending in a plane from spaced points on said base for supporting of the bottom said hanger, said first and second rods being connected by an arcuate section, at least a potion of said arcuate section being inclined relative to said plane, a third rod extending from said base to said arcuate section and means for mounting said base on a vertical surface.

8. The combination of claim 7 wherein said hanger has a generally triangular configuration and wherein said first, second and third rods extend from points on said base which form the vertices of a triangle.

9. The combination of claim 7 wherein said third rod has an arcuate portion.

10. The combination of claim 9 wherein said arcuate portion of said third rod is joined to said arcuate section.

11. The combination of claim 9 wherein said base comprises a member extending generally perpendicular to said plane and wherein said third rod extends from said member.

12. The combination of claim 7 wherein said base has a generally rectangular configuration including two corners and wherein said mounting means are situated proximate said corners.

* * * * *